United States Patent [19]

Hurd

[11] 4,232,904

[45] Nov. 11, 1980

[54] METHOD AND APPARATUS FOR DEEP MINING USING CHAIN DRIVEN IN FIXED DIRECTION

[76] Inventor: Robert L. Hurd, 2063 Manor Dr., Lexington, Ky. 40502

[21] Appl. No.: 13,749

[22] Filed: Feb. 21, 1979

[51] Int. Cl.[3] ..... E21C 29/14; E21C 41/04

[52] U.S. Cl. ..... 299/18; 299/34; 299/35; 299/84

[58] Field of Search ..... 299/32, 34, 35, 82, 299/83, 84, 18

[56] References Cited

U.S. PATENT DOCUMENTS

| | | | |
|---|---|---|---|
| 1,998,877 | 4/1935 | Lawson | 299/35 |
| 2,049,171 | 7/1936 | Osgood | 299/35 |
| 4,065,184 | 12/1977 | Tipper | 299/34 |

FOREIGN PATENT DOCUMENTS

| | | | |
|---|---|---|---|
| 958191 | 2/1957 | Fed. Rep. of Germany | 299/35 |
| 1207313 | 12/1965 | Fed. Rep. of Germany | 299/34 |
| 1427064 | 12/1966 | France | 299/35 |
| 146466 | 5/1961 | U.S.S.R. | 299/35 |

*Primary Examiner*—Ernest R. Purser

[57] ABSTRACT

A coal mining technique is disclosed whereby the coal, which is to be removed from horizontal seams, is cut from the inside of the seam first, thereby allowing the earth around the seam to collapse behind the cutting blades. In one embodiment, a tunnel is bored into the seam from a front surface of the hill. The tunnel is constructed into a "U" shape such that both an entrance and an exit hole are laterally displaced along the front surface of a hill. A chain drive having rotating cutters spaced therealong is drawn through the tunnel by a motor located outside the tunnel. The motor provides continuous outward pressure on the chain, causing the blades to rotate, thereby cutting the coal from the inside back wall of the tunnel. Buckets mounted along the chain serve to remove the coal from the tunnel. When rotating blades are not used, cutters may be mounted on the outside of the buckets to chip the coal from the seam. As the chain assembly is drawn forward through the coal seam, the earth covering is free to fill the tunnel from the inside, thereby leaving the terrain untouched.

11 Claims, 26 Drawing Figures

| BIT SPACING SEQUENCE ——— R, F, 4, 2, 8, F, R, 1, 6, F, 9, 1 REPEAT ___ |
|---|

METHOD AND APPARATUS FOR DEEP MINING USING CHAIN DRIVEN IN FIXED DIRECTION

FIELD OF THE INVENTION

This invention is in the field of mining techniques and, more particularly, relates to an arrangement for removing hard minerals, such as coal, from the horizontal face of a hill.

BACKGROUND OF THE INVENTION

Mining the earth for hard minerals, such as coal, is one of the oldest formalized endeavors known to civilization. Coal mining companies, together with copper mining, trace their history back in an unbroken pattern for generations. From the earliest times when slaves were used, even through today, mining is a dangerous occupation. The danger lies in several areas, primarily because of the inherent structural weakness caused in the earth as the mineral is removed.

Coal mining poses particular problems mainly because of the depths involved and the tendancy for coal mining to release explosive gases.

Coal, as is well-known, is a vegetation product which has undergone countless years of pressure inside the earth. In some situations, the earth has formed upward and thus the coal may be found in seams inside a hill or mountain. One method of removing this coal is known as strip mining, where the earth and rock covering is stripped away and the exposed coal removed from the seam. Such a procedure eliminates, for the most part, the need for people to enter the earth through tunnels. However, it becomes necessary in a strip mining operation to remove large areas of earth in an effort to uncover the coal. There is, of course, a point beyond which the cost of earth removal exceeds the selling price of the mined coal. When this point is reached, the strip mine is abandoned, even though the seam of coal is not depleted. In some situations, when it becomes uneconomical to strip away the earth covering the coal, large augers are used to bore out coal. Even using the boring method, which results in pockets in which water collects, vast amounts of coal are left unmined. In many situations, especially where the coal seam is less than twenty inches in height, augering is impractical.

Thus, it is readily seen that, especially in an era when energy sources are at a premium, it is desirable to remove as much coal as possible from known coal seams and to do so at the lowest possible cost.

Further compounding the problem is the valid concern for our environment. Abandoned coal mines can be dangerous. Explosive gases may collect or children may somehow find their way inside. Water, which naturally flows into the mines, may become contaminated and run out into our lakes and streams. The list of dangerous possibilities is only limited by one's imagination.

Based on these concerns, stringent laws have been enacted to protect against the possibilities of danger. The sum effect of the laws and the regulations which have been promulgated in support thereof is that mining companies must adhere to strict standards in their mining operations. As the requirements become tougher, the cost of mining operations rise and a point is reached where it becomes uneconomical to mine coal. At that point, everyone is the loser.

For the most part, the environment can be best served, and the regulations are established, to insure that after a hill is strip mined, the earth is restored. Two factors are thereby achieved. First, the environment does not appear scarred and disturbed. And second, tunnels or holes do not remain to fill with acid water. While proper earth restoration is desirable, it still requires a number of years before nature can fully heal the wounds.

Thus, a need exists in the art for a mining technique to be applied which does not leave behind an unsightly or unsafe environment. Such a technique must be economical and must be able to mine the coal at the deepest sections of a mountain, as well as those sections of the coal seam which are near the surface. In addition, such a technique must mine coal seams of varying thicknesses and have a high degree of safety for the miners.

SUMMARY OF THE INVENTION

These and other problems have been solved by an arrangement designed to remove the coal from the deepest portion of the coal seam first, working forward to the operator position. Based on the concept, and in one embodiment, a hole is bored into the coal seam from the front surface of the hill. The hole, or tunnel, is formed into a "U" shape such that at the far end of the coal seam (deep within the mountain), the hole is bored substantially parallel to the front surface of the hill for a pre-established distance. The tunnel is then turned back toward the front surface of the hill. Thus, looking at the hill from the front, one would see two holes, extending inward. The two holes would be connected at the far end to form the "U". The entire tunnel would then be expanded to the thickness of the coal seam.

A chain drive, having cutters spaced thereon, is then inserted into one hole and brought out through the exit hole. Distributed along the chain between the cutters, are buckets to scoop out the coal which is cut from the inside of the seam by the rotating cutters.

In operation, a large driving force is established outside of the holes at the front of the hill, and is arranged to apply continuous outward pressure on the drive chain. The driving force turns the chain, causing the cutters to rotate. The cutting edges of the rotating cutters dig into the coal seam, dislodging the coal, which is then scooped from the tunnel by the trailing buckets. Since the chain is constantly being drawn outward, as well as being rotated through the tunnel, the cutting blades are primarily in contact with the inside back wall of the tunnel. Under such an arrangement, the coal is mined from the inside of the mountain first. Thus, as the tunnel becomes enlarged, the mountain is free to collapse behind the cutting blades, thereby filling in the tunnel.

Since the outside surface of the hill is untouched, except for the entrance and exist holes, environmental impact is negligable.

A further advantage of my arrangement is that the bulk of the equipment is external to the tunnel, with only the chain drive, the cutters and the buckets inside the hill. Since it is possible to drill the entire tunnel by equipment operated from the front of the hill, it is possible to mine the coal seam without requiring a miner to enter the earth.

In those situations where traditional methods have been utilized priorly, my arrangement may be advantageously utilized to extract from the coal seam the vast amount of coal left behind. This can be accomplished, for situations where the hill has been faced and abandoned, by running the chain drive around the exposed coal seam. The driving force is then set up at one location. Since the cutters will only cut the coal where they make contact with the same, the coal will be cut from the farthest point first. Since the trailing buckets serve to drag the coal to the front area, miners are not required to be present in the cutting area. As the coal is cut away from the earth, the chain continues to pull the cutters inward, undercutting the hill. A point is reached where the hill then slides downward, filling in the cut behind the rotating cutters. Using this procedure, the yield from a given coal seam is increased considerably.

In another embodiment of my invention, individual buckets are equipped with cutters along one side. The buckets are hinged to each other and attached to the main driving chain. The cutters are mounted at varying positions along the sides of the buckets so that a train of such buckets will serve to remove coal from the seam. The coal so removed will be scooped into the bucket by a ramp on the side of the bucket.

Hinges between the buckets allow for flexible movement along the seam while hinges at the bottom of each bucket allows the coal to dump out when the bucket exists from the tunnel. One such bucket is the subject of concurrently filed copending application of R. L. Hurd, et al Ser. No. 013,750 which application is hereby incorporated by reference in this application.

In addition to those problems discussed above for which this mining technique is the answer, the following difficult problems are also solved:

deep mining where tunnels have been dug and where earth supports, containing coal, had to be left behind for structural support;

cutting the coal from the hillside where intersecting tunnels have been dug;

removing the pillars from deep mining tunnels; and cutting the coal from a seam inside the top of a hill where it would be less economical to strip the earth under conventional methods.

DESCRIPTION OF THE DRAWING

These objectives and features, as well as others, will be more fully understood from a brief review of the Drawing, wherein:

Turning now to FIG. 1, an arrangement is shown where the cutters are placed along a chain drive around the outside surface of the hill. As discussed hereinbefore, such an arrangement is but one way to utilize my invention. Most probably the concepts discussed in this patent will find use in removing coal from tunnels formed inside the earth, which tunnels may be straight, curved, or intersecting and may terminate in a single face of the hill or on different sides of the hill. The location of the actual cutting is determined by the tension applied to the cutters and by the chain drive tensioners, such as 702, 703 shown in FIG. 7.

As shown in FIGS. 1 through 5, as the cutters are pulled around the coal seam, they rotate, causing their cutting edges to contact the coal seam, thereby chipping coal from the seam. The coal falls to the floor and is scooped up by trailing slides also attached to the chain drive. As the seam is mined, external power source 90 is moved away from the coal seam by an outward force exerted by hydraulic pump 92. When drive source 92 moves to the end of its slide 91 then the system is stopped and a portion of the chain removed. Power source is moved forward and again the cutting begins with power source 90 slowly being driven outward.

As the outward movement continues, the cutters remove the coal from the seam and the earth behind the cutters is free to settle into the cut. Since humans are not in the tunnel, there is no danger of injury and since the bulk of the equipment is located outside of the mining area, even when the cutters are working in a tunnel, there would be little property damage even should a slide occur.

It is important to understand that while reference is made to a chain drive, any such device such as wire rope, or roller chain can be used. The length of the system will depend only upon the strength of the material chosen.

Figure 1:
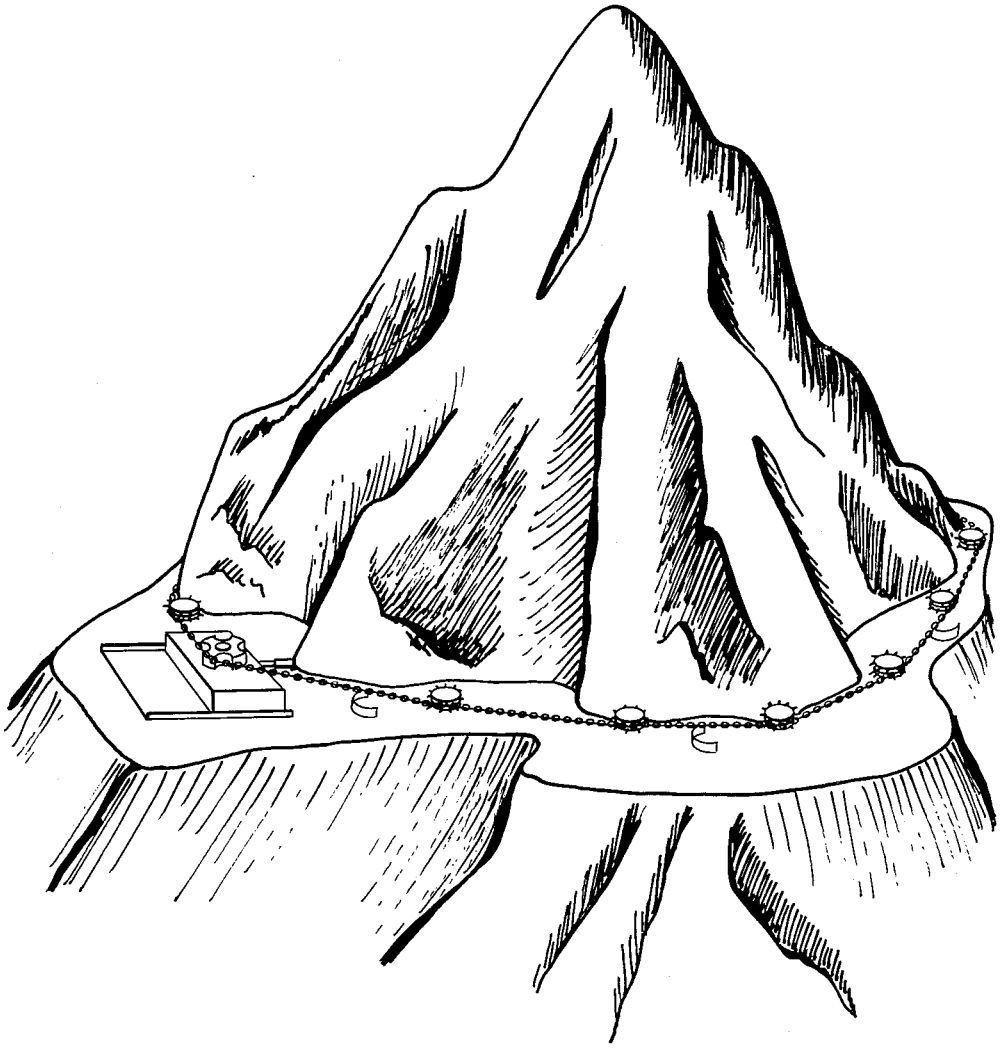
FIG. 1 shows a chain driven cutter working on the outside of the mountain.
Figure 2:
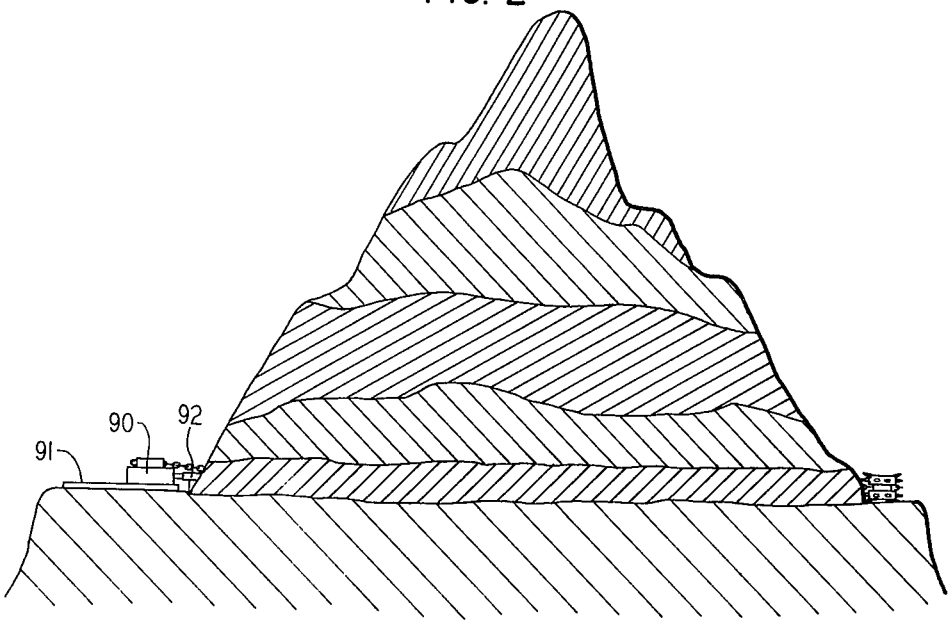
FIGS. 2 through 5 show the cutters working their way into the mountain and the earth filling in behind the cutters.
Figure 3:
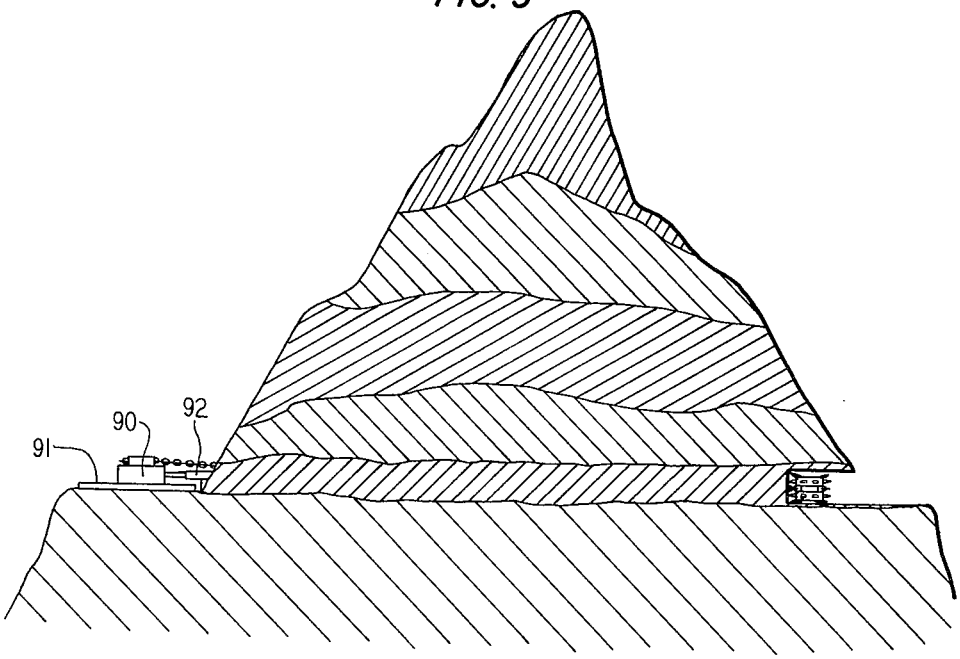
Figure 4:
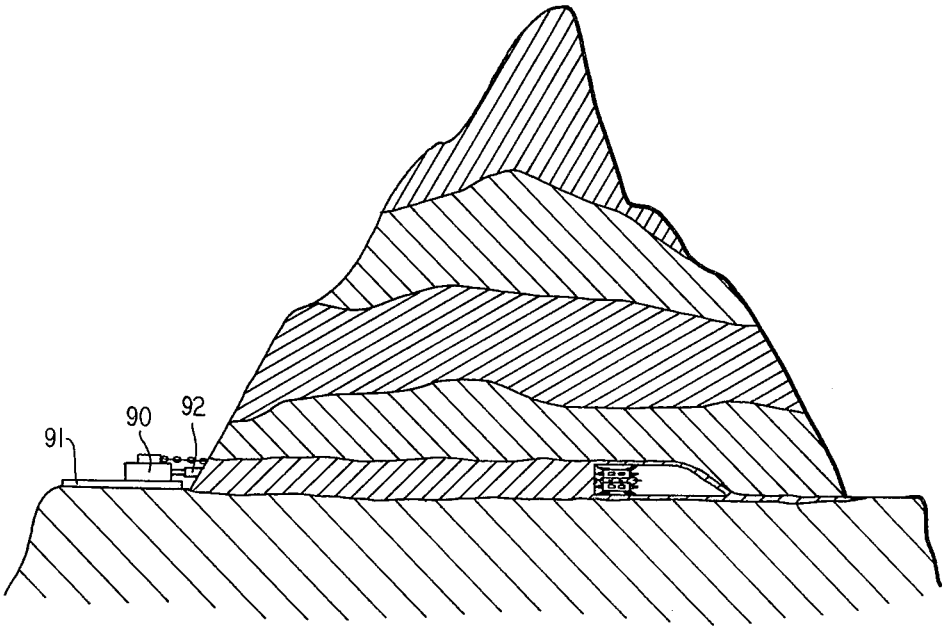
Figure 5:
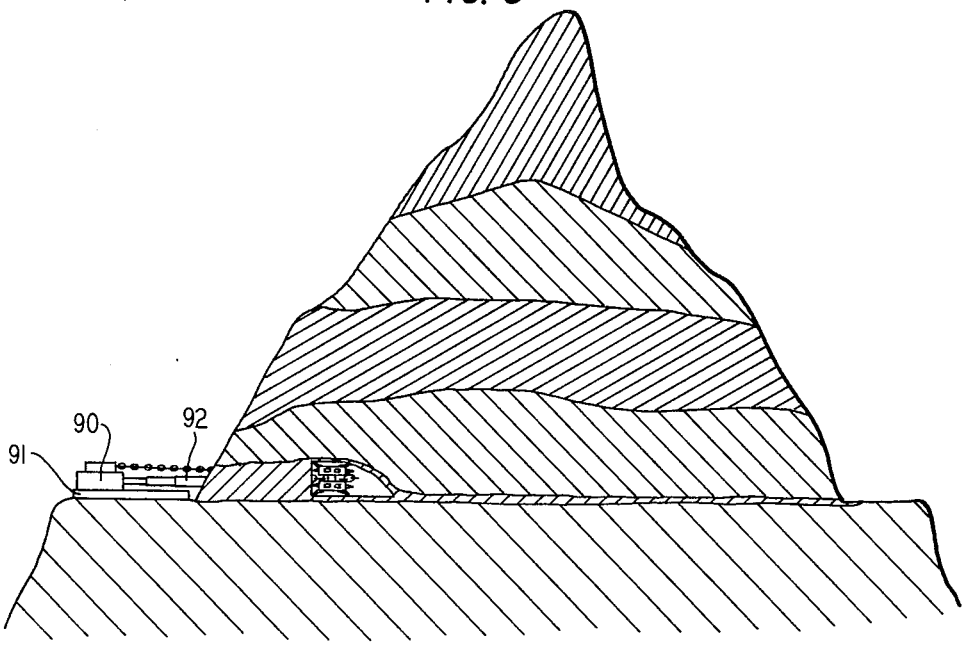
Figure 6:
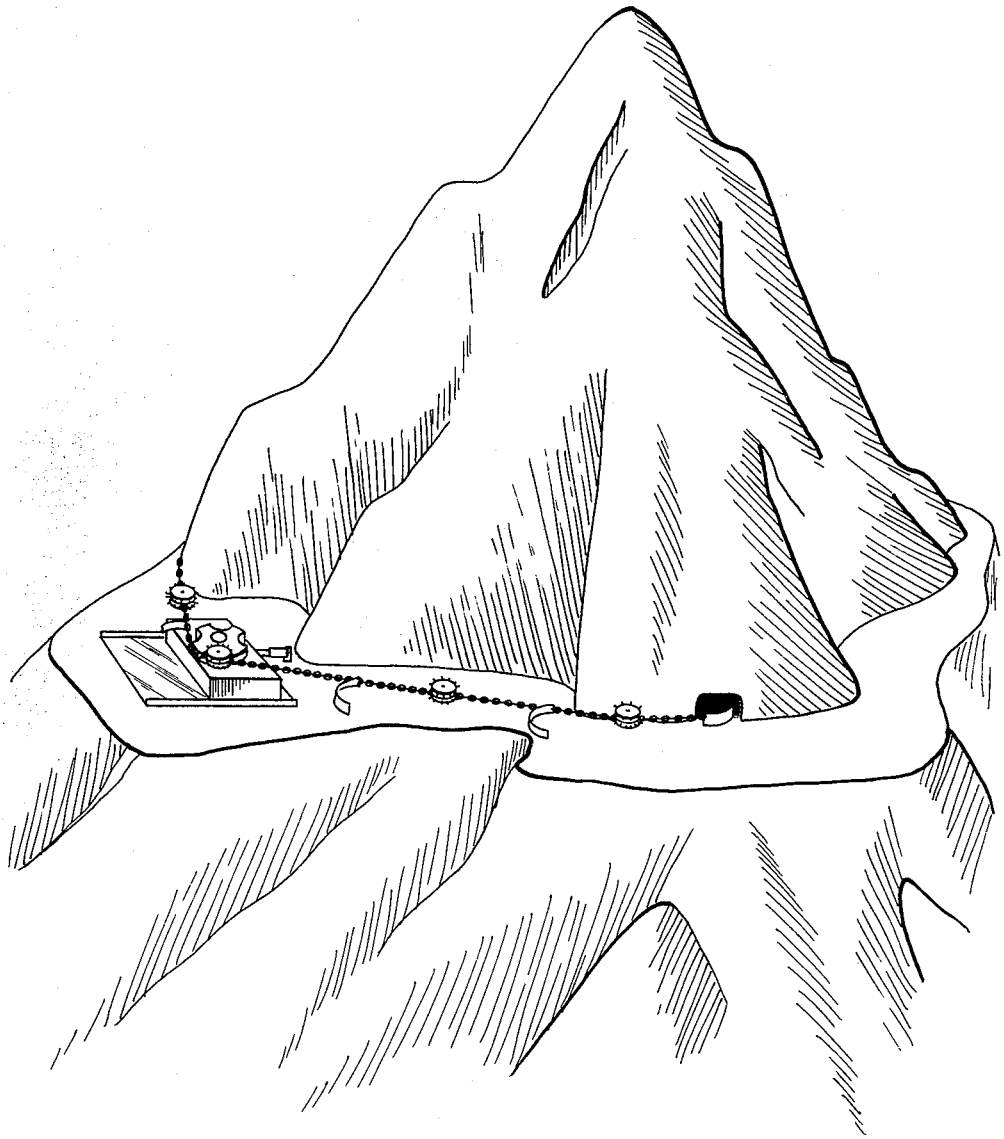
FIG. 6 shows the cutters working through a tunnel in the mountain.
Figure 7:
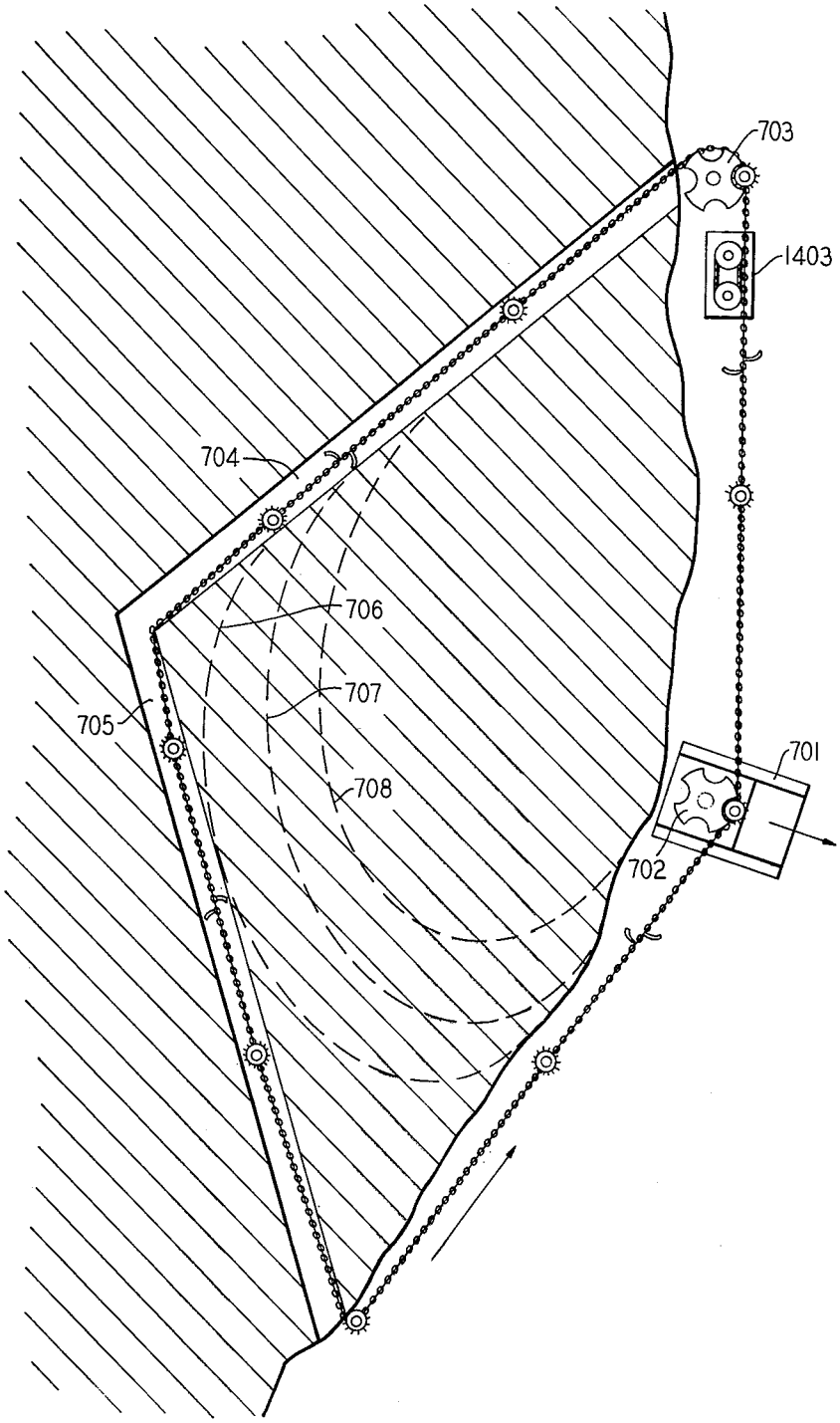
FIG. 7 shows a schematic top view with the cutters working partially inside and partially through intersecting tunnels in the coal seam.
Figure 8:
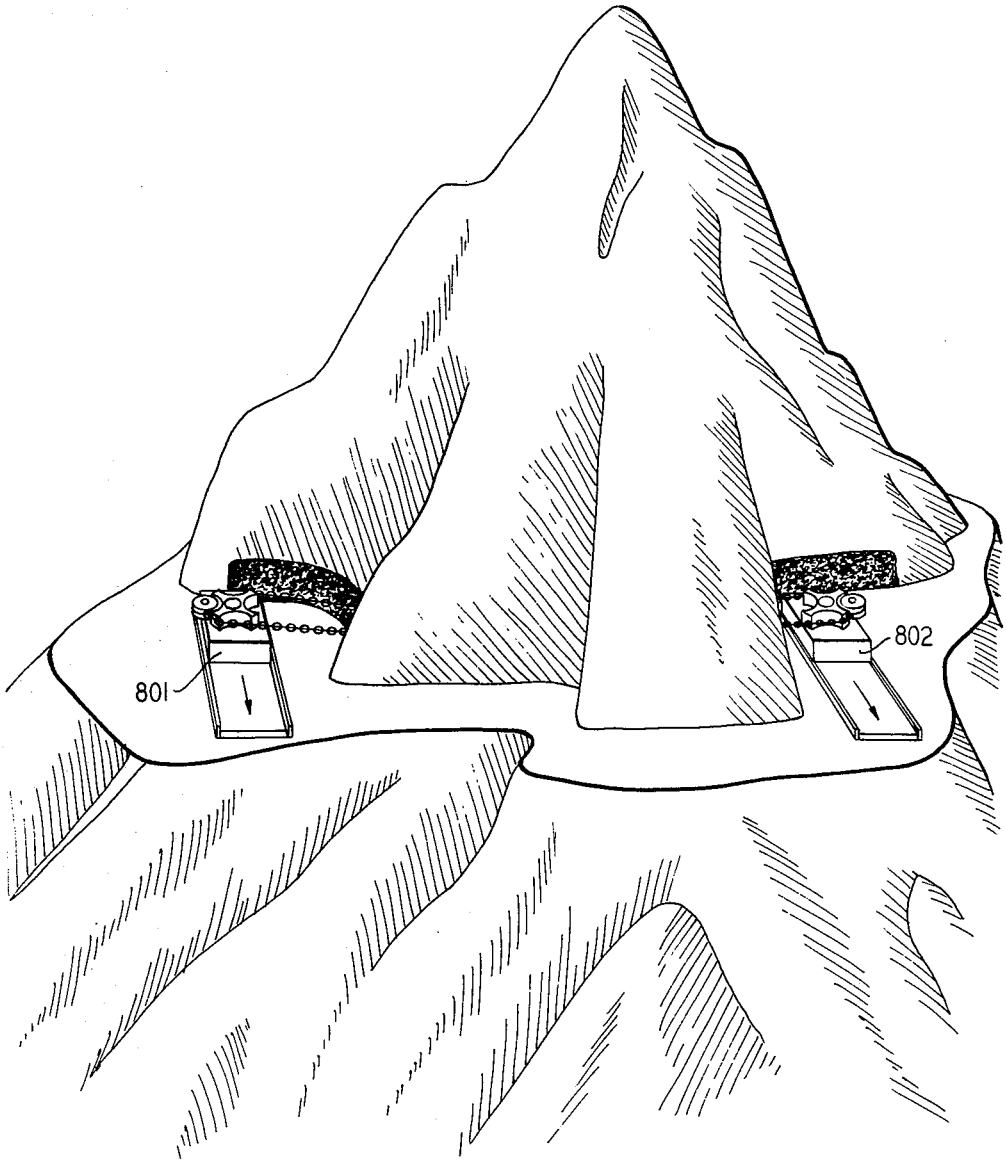
FIG. 8 shows a schematic top view of the cutters working through parallel tunnels cut through the coal seam.

In FIG. 6, the cutter system is shown going through a tunnel in the side of the coal seam while in FIG. 7 the cutter system is shown passing through two intersecting tunnels. As the system operates, power source 702 is driven outward, as discussed, and the chain shortened as necessary. As time passes, tunnels 704 and 705 begin to take on the shape similar to dotted lines 706, 707 and 708 with the coal from the seam always being deposited outside of the tunnels in the manner to be discussed hereinafter. In FIG. 8, the removal system is shown going entirely through the seam in two parallel tunnels or going in both directions within one tunnel. In such an arrangement, power can be applied at both exists by power sources 801 and 802.

Figure 9:
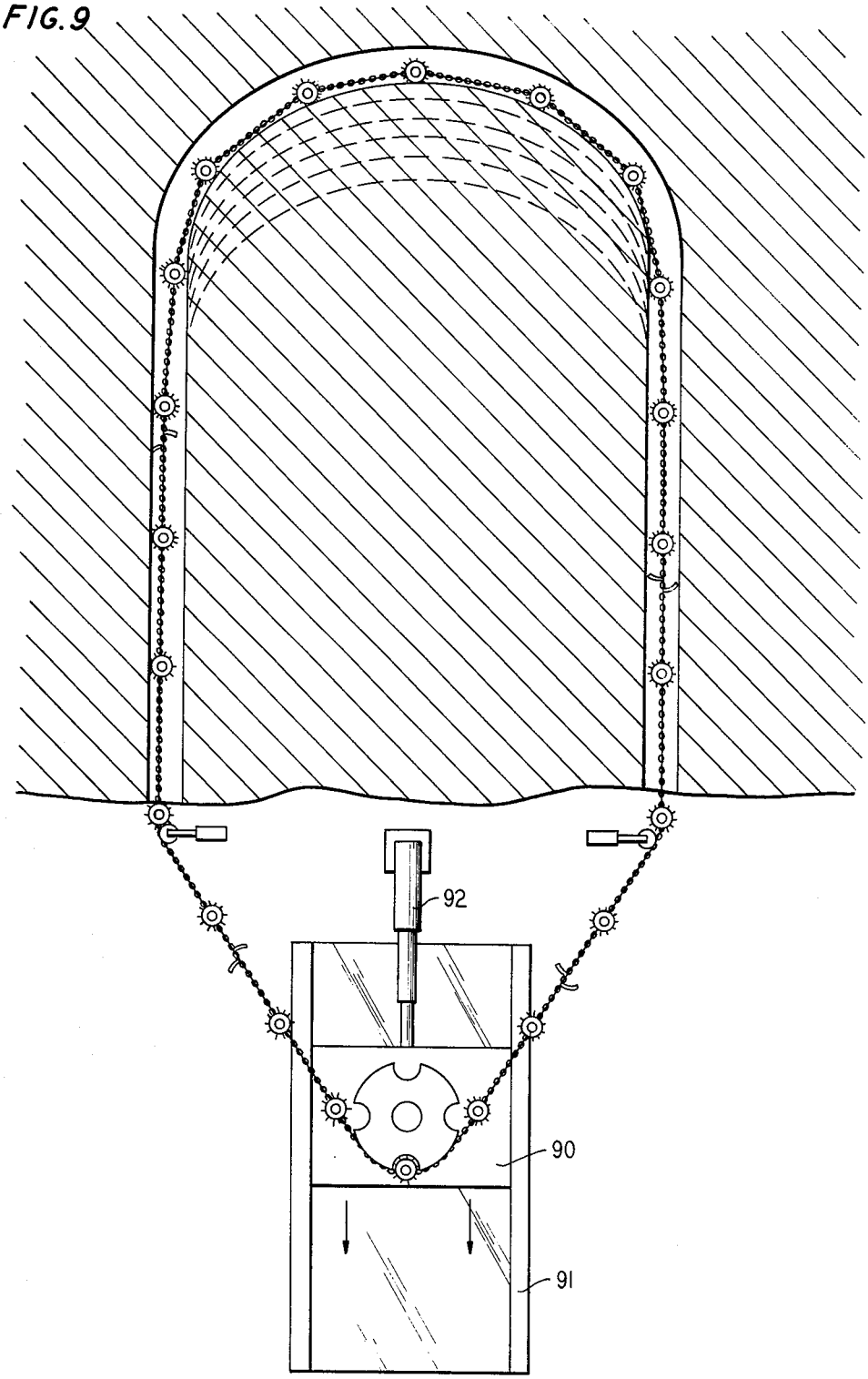
FIG. 9 shows a schematic top view of the cutters working through a U shaped tunnel cut into the coal seam.

FIG. 9 shows in more detail that outward pressure is applied to power source 90 by a two directional hydraulic cylinder 92 or any other equivalent force applying device. Details of typical power source will be detailed hereinafter. The power source may move along slide 91 which slide may be any suitable length and should ideally be long enough so as to avoid the need for frequently shortening the chain drive.

This mining technique is suitable to mine coal or any other mineral deposits that lie in a relatively flat plane for the section of coal being removed. The plane of the seam may be horizontal or may be tilted to any degree. Undulating or faulted seams may be mined in a series of separate flat sections not parallel with each other, and provision may even be made to add or subtract cutting blades as the seam changes thickness through the deposit.

Figure 10:
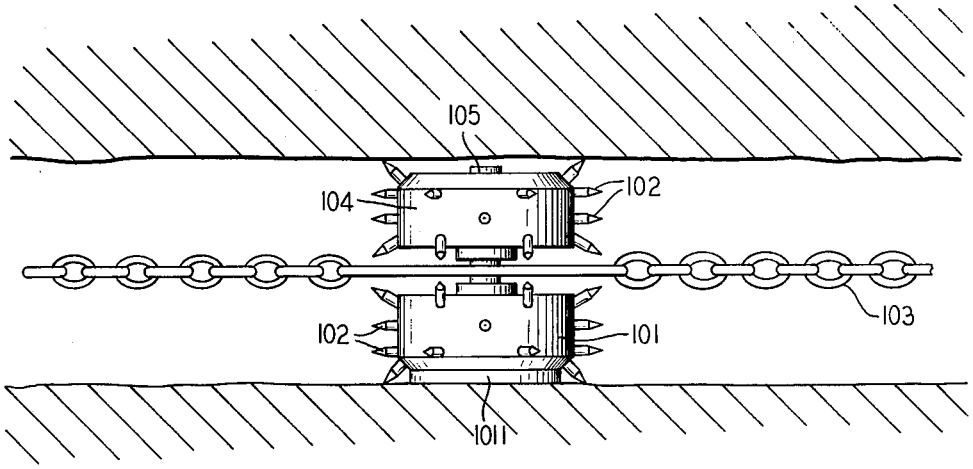
FIGS. 10, 11 and 12 show an embodiment of the circular cutters and skid plates to mine and remove the coal.
Figure 11:
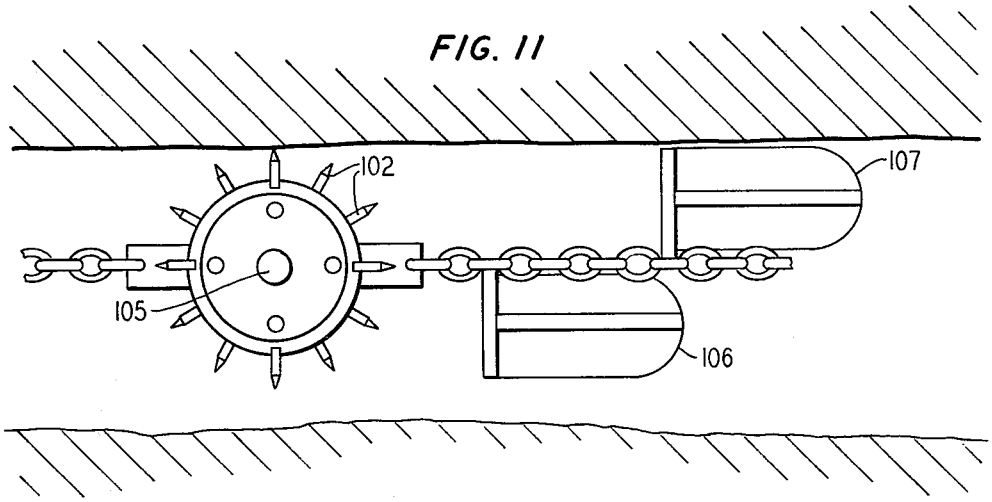

One arrangement for the cutting blades is shown in FIGS. 10 and 11 and consist of a plurality of circular shafts 101 mounted to the chain drive. A group of such shafts are spaced apart on the chain. Around the periphery of each shaft are a number of cutting blades 102 projecting outward from a center spindle 105. These blades are maintained in contact with the surface of the coal to be mined and, as chain 103 advances forward, the blades chip the coal from the seam. Scoops 106 and 107 along the chain, serve to remove the coal from the seam. Note that as many shafts 101 as are needed for the height of a given tunnel may be added to each cutter group. The blades or bits are of the well-known type commonly used for mining operations.

The top blade, or blades, operates to cut coal from the top of the shaft or tunnel while the bottom blade operates to cut coal from the bottom or floor of the tunnel. Since cable 103 is being drawn continuously forward by the externally mounted power source and since the individual cutter assemblies are mounted on the cable in a manner which allows them to circularly rotate about their individual axis then each blade assembly rotates as it is drawn forward, thereby bringing into contact a succession of blades. A rubbing block, 1011, can be used to prevent the blade from digging into the tunnel floor.

In some situations, it may be desirable to mount a motor in each blade assembly to aide in turning the assembly. Such a motor could be air driven or electric driven and could obtain power from an external source by cables or from an internal source by commutators. In some embodiments, the power to drive each such rotatable assembly could be self-contained in each assembly and could be recharged during the period of time each assembly is outside of the tunnel.

Figure 12:
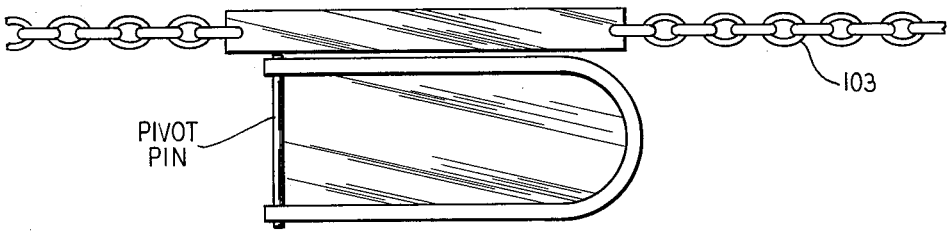

The scoops of such a system are constructed, as shown in FIG. 12, are drawn along the tunnel attached to the chain at intervals. Each scoop is constructed with a pivot pin so that when the scoop is outside the tunnel with no floor to support the scoop, it will tilt and dump the coal, or other mined material, into waiting hoppers (not shown).

As the coal is mined, the outside power source is drawn away from the tunnel opening so as to continuously apply outward pressure. When the power source arrives at the end of its outward travel, it is stopped and a section of chain removed. The power source is then moved forward and the process continues.

Figure 13:
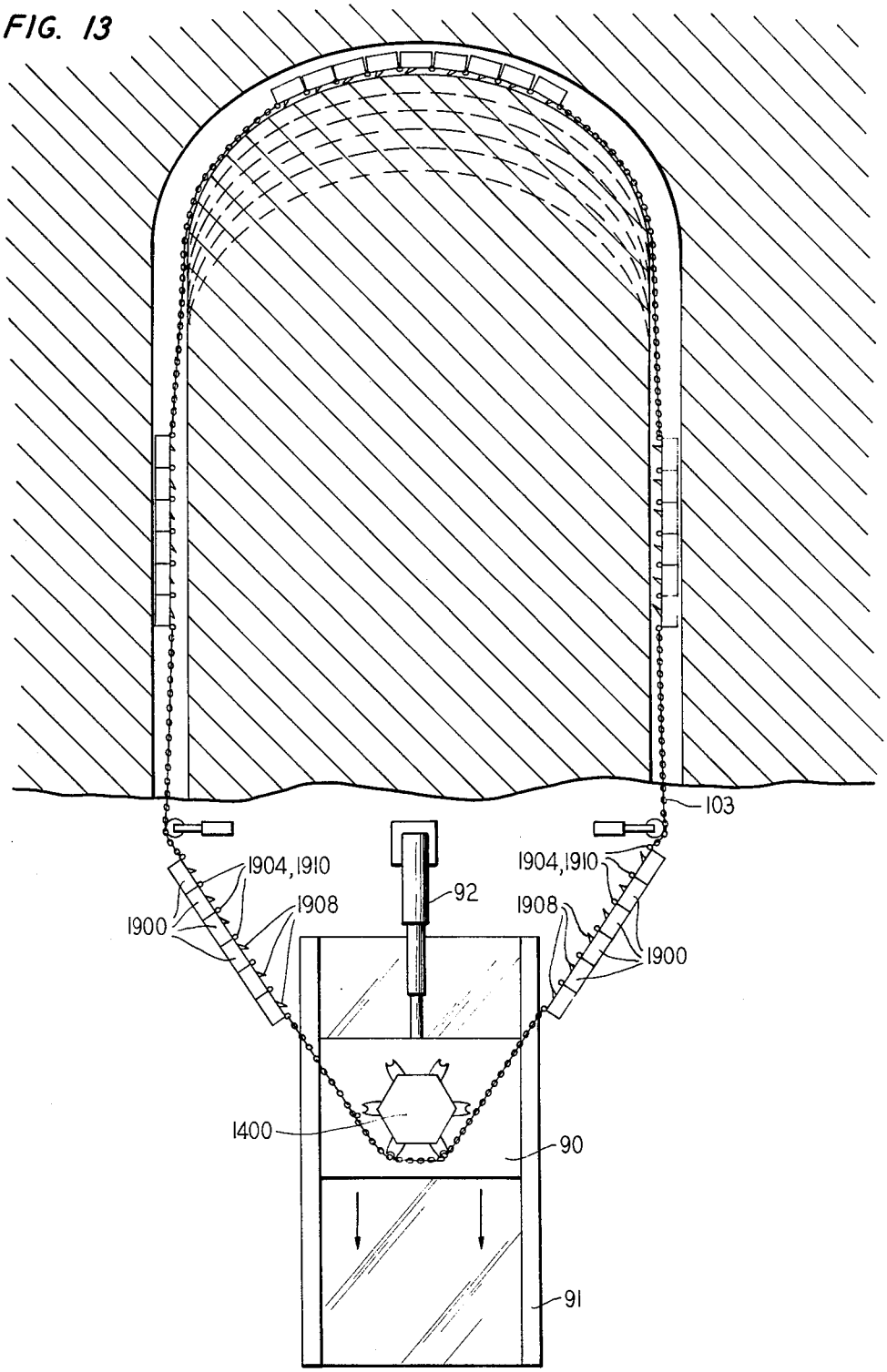
FIG. 13 shows a schematic top view of the buckets working through a U shaped tunnel cut into the coal seam.

As shown in FIG. 13, an alternative method of mining the coal, and the arrangement which now appears to be the best mode, is shown where bucket trains are used. The buckets can be of the type shown in the aforementioned concurrently filed U.S. patent application of R. L. Hurd, et al. Such buckets are attached to each other by hinges and form, in one embodiment, a continuous train, each having one or more cutters on its side, each cutter serving to chip coal from a particular level of the coal seam. By arranging the cutters in a specified order according to position, the coal may be mined in a uniform manner throughout the tunnel. For ease of discussion, it will be assumed herein that each bucket has mounted thereon a single cutter positioned at a particular height relative to the floor of the tunnel. Thus, in FIG. 24, there can be seen several of the positions where cutters should be mounted. The cutter holder 1907 may be welded, bolted or otherwise attached to the bucket so that blades 1908 attached to each holder are at certain positions. Thus, blade F is the floor cutting blade and may be arranged for various distances from the bucket depending on the slope or unevenness of the floor.

Figures 24, 25:
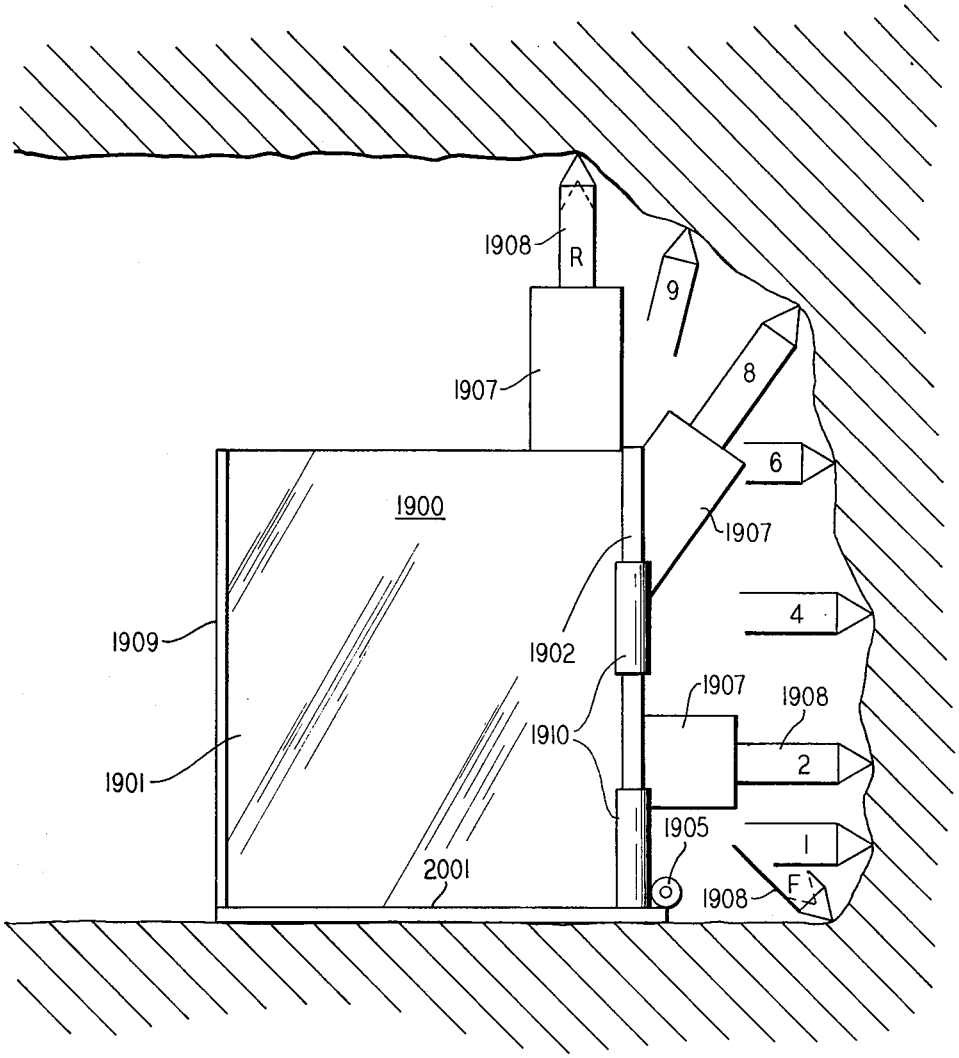

For example, if the floor of the tunnel is bumpy then the F cutter can be extended only slightly so as to cut away only the tops of the bumps. As these tops are reduced, the F cutters can be extended so that eventually the entire floor is level. The same procedure can be followed with the roof cutting blade R. One suggested cutter spacing is shown in FIG. 25, where each blade is carried by a separate bucket following one after the other in the pattern shown. The sequence shown is for a typical ten inch cut. To insure a smooth floor cut three cutter bits of the twelve bit sequence will be cutting at the floor level, while two will be cutting at the roof level. Two bits (numbered "1" in FIG. 24) will be cutting at the one inch level. Note that the bits are alternated on adjacent buckets so that one bit cuts high while the next following bit cuts low. This alternation will tend to balance the forces on the system and to keep the sides of the tunnel relatively square.

As a coal seam or other ore deposit is mined, the system may tend to either drift downward within the seam and/or into the floor, or it may tend to drift upward toward or into the roof of the seam. To prevent such drifting, blade F is positioned to be either shorter or longer to cut the floor level direction either higher or lower, respectively, than on previous passes through the tunnel. The purpose of lengthening or shortening the floor bits is to redirect the cutting direction to maintain the mining operation within the seam or ore deposit body.

Figure 26:
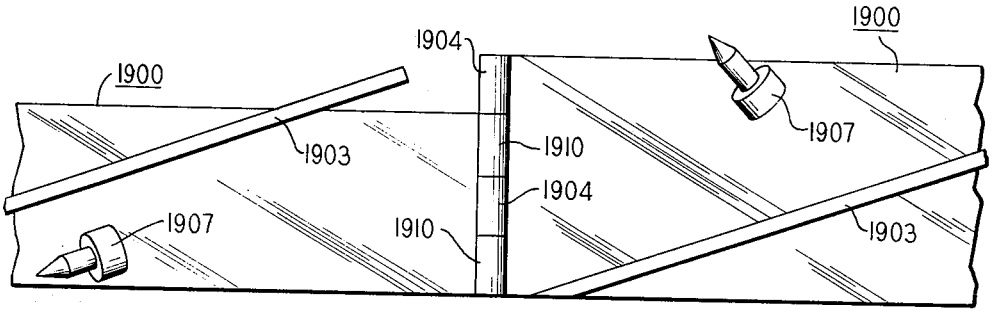

As the cutters chip away the coal, it is free to fall into the bucket or onto the tunnel floor. On the side of each bucket, there is mounted a slide which serves to scoop the coal from the floor up into the bucket for removal from the tunnel. Each bucket is arranged, as will be discussed, so that as the floor falls away when the bucket comes out of the tunnel, the coal is dumped into waiting hoppers. Different size buckets may be used, some with lower sides, as shown in FIG. 26 so as to insure adequate clearance for the coal to enter the moving buckets. The size of the buckets depends upon the height of the coal seam and one size may serve many differing height seams simply by varying the position and extension of the cutter holders 1907.

Since it is important to eliminate the human element from the tunnels, TV cameras or other monitoring devices, such as gas detectors, radar, recorders, may be mounted on special buckets for the purpose of surveillance of the mining operation.

In addition, each cutter may be spring loaded or mechanically moveable and remotely or automatically moveable so that the position of a blade may be changed in various places along the tunnel. Such adjustment may occur as a result of preset signals or under control of an external operator, as, for example, by radio signals transmitted to a particular bucket.

Figure 19:
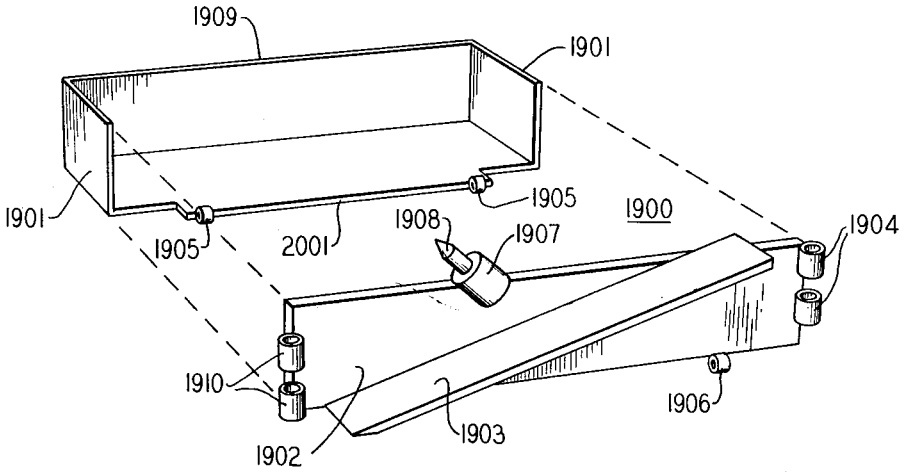

Such a bucket 1900 is shown in exploded view format in FIG. 19 and consists of a side plate 1902 to which a ramp 1903 is attached, preferably by welding. Cutter assembly 1907, 1908 is mounted to plate 1902 in a position discussed previously. More than one such blade may be attached to plate 1902. Hinges 1904 and 1910 are positioned as shown along the trailing and leading ends of plate 1902 and serve to connect each bucket with the preceeding and following buckets, as shown in FIG. 26.

Figure 20:
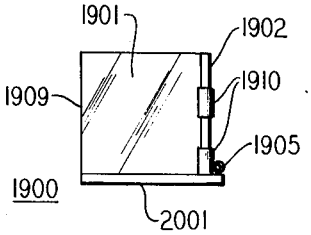
FIGS. 20 through 26 show details of the buckets.
Figure 21:
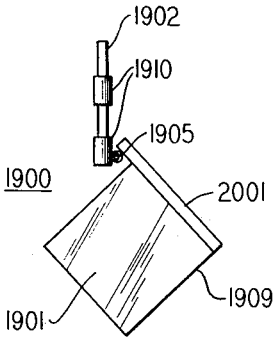

At the base of plate 1902, there is shown hinges 1905 which serve to connect plate 1902 to the bottom plate 2001 of the bucket assembly. Connected to bottom plate 2001 are two side plates 1901 and 1909. When bottom plate 2001 is being supported by the floor of the tunnel, then the structure that results is a closed box or bucket into which coal, which is chipped from the tunnel by the blade assemblies, may be carried out of the tunnel. Once on the outside of the tunnel, a dummy floor is constructed so that the bucket will remain closed. In this manner, the coal in the bucket is transported to a hopper or coal chute. When the bucket is positioned, under control of the moving interlinked train, over the coal receptical area, the dummy floor terminates, thereby allowing the bucket to swing open via hinge assembly 1905, 1906 and, as shown in FIG. 21, the bucket tilts and the coal spills therefrom. A ramp is used to close the bucket before it reenters the tunnel. In FIG. 20, the bucket is shown in the closed position being supported either by the tunnel floor (not shown) or by a dummy floor outside of the tunnel (not shown).

In FIG. 13, there is shown buckets in groups separated by a chain drive. However, it is contemplated that the best mode would be to interlink all of the buckets and eliminate the chain drive.

Figure 22:
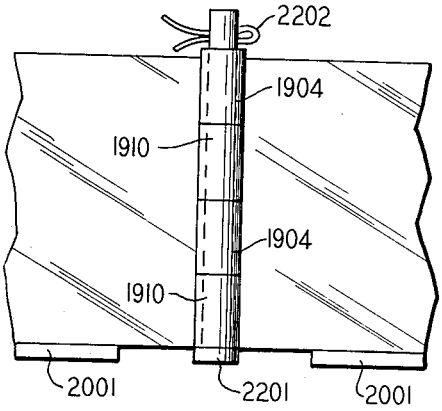
Figure 23:
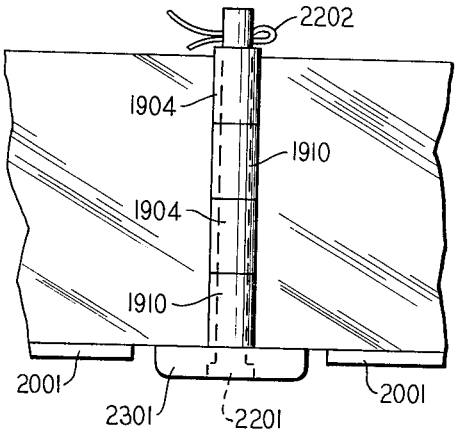

In FIG. 22, there is shown a cotter pin 2201 or large bolt inserted into the hinge assemblies 1904, 1910 between the buckets. A cotter pin, castle nut, or similar device serves to hold the assemblies together. Since each bucket is hinged to the bucket in front and behind, the assembly is free to turn corners in the same manner as does a train.

In situations where correction or drift compensation is needed, a spacer 2301 is inserted, which spacer rides on the floor of the tunnel, thereby maintaining the buckets in the proper plane.

As shown in FIG. 26, buckets 1900 can be of varying sizes and the cutters 1907 may be mounted above or below ramp 1903.

Figure 14:
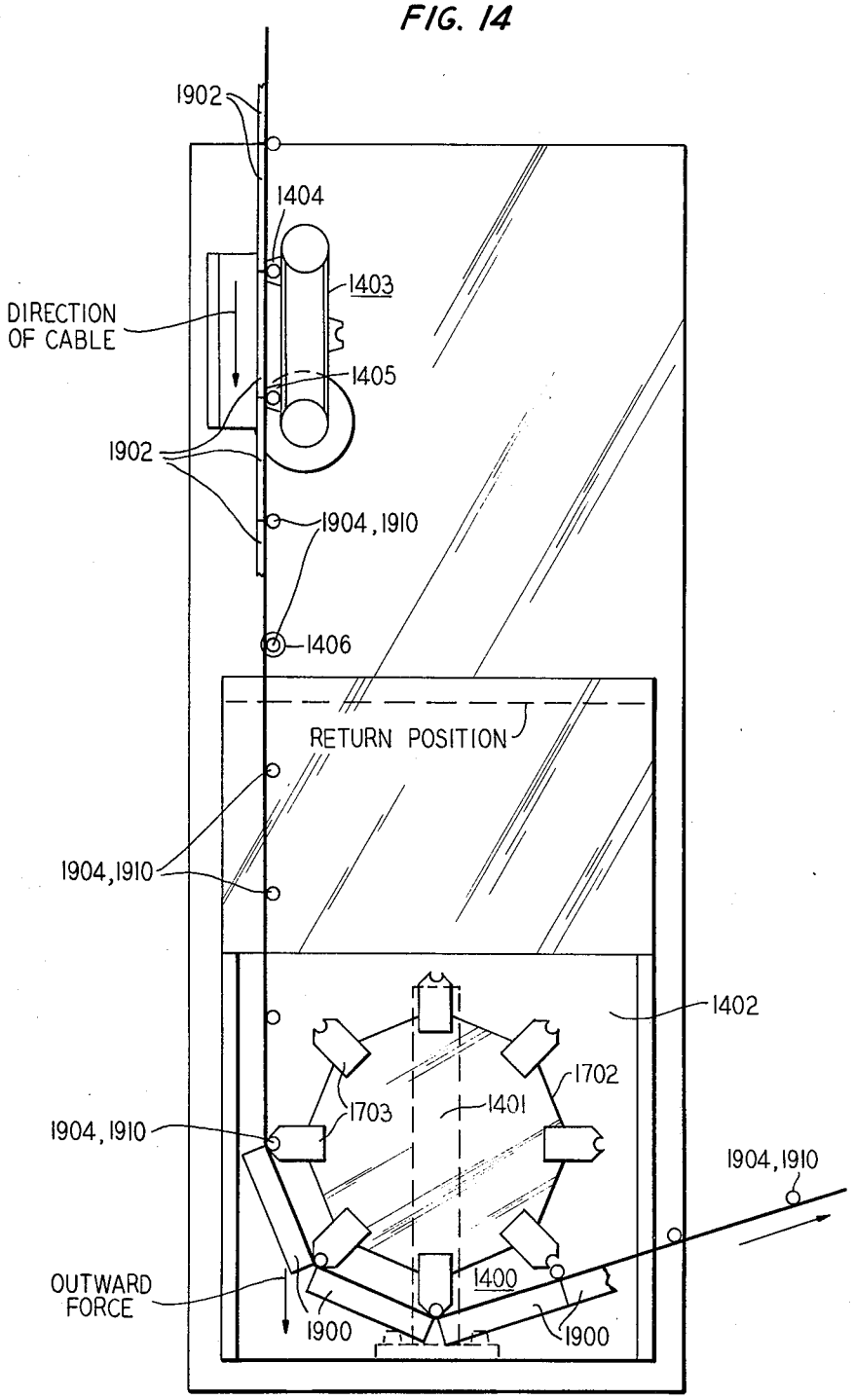
FIGS. 14 through 18 show details of the drive mechanism for the bucket system.
Figure 17:
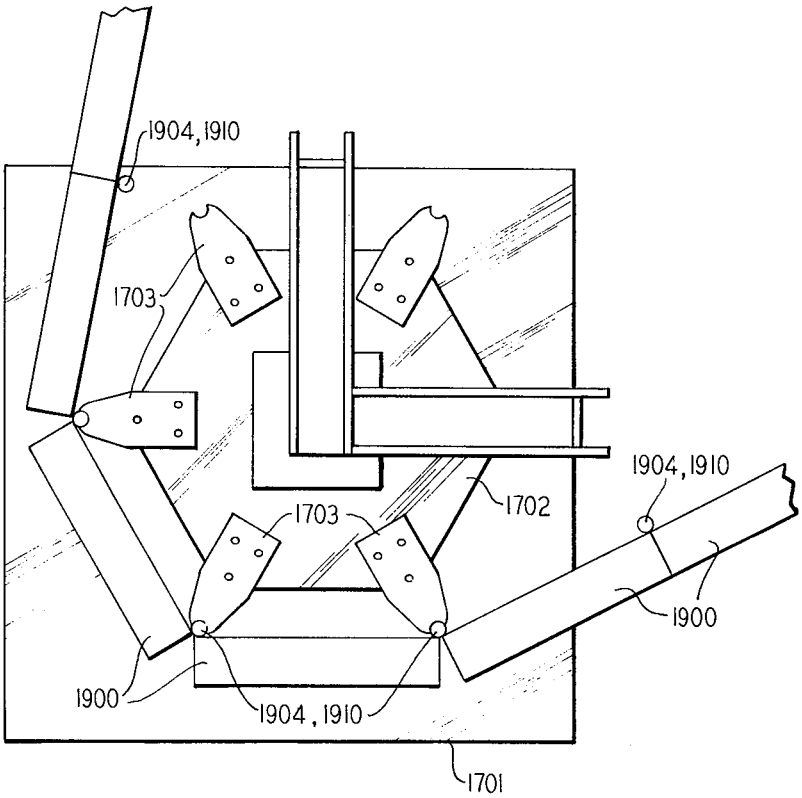
Figure 18:
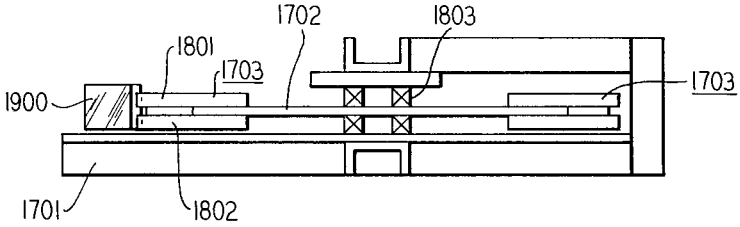

As shown in FIG. 17, a large structure 1701 is constructed outside of the mine tunnel and holds circulating table 1702 having arm 1703 positioned to engage hinge assembly 1904, 1910. The purpose of such engagement is to impart constant outward force, as shown in FIG. 14, on the bucket train. This is accomplished by hydraulic cylinder 1401, causing table 1702 to slide outward via slide plate 1402. If additional forward power is necessary, the table can be powered by a rotary motor. As shown in FIG. 18, arm 1703 has a top half 1801 and a bottom half 1802 mounted to table 1702. The table is driven, if necessary, by a motor connected to the center 1803.

Also, as shown in FIG. 14, power station 1403 is designed to impart forward momentum to the bucket train via arms 1404 and 1405.

Figure 15:
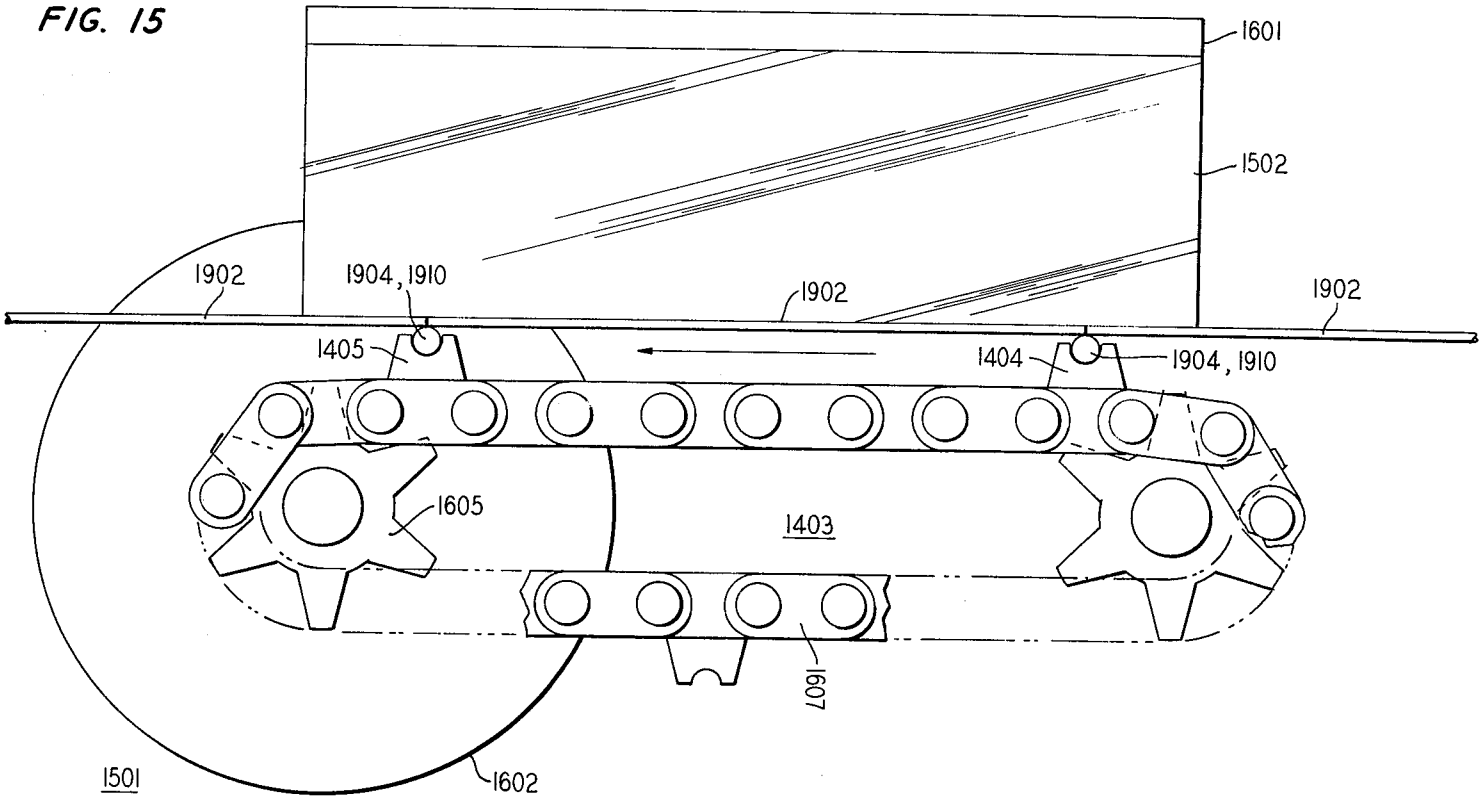

FIG. 15 shows a top view of power station 1403 where a chain drive 1607 has mounted thereto a first arm 1405 for engaging the leading hinge assembly of a bucket and a second arm 1404 for engaging the trailing hinge assembly of a bucket. More than one such pair of arms will be mounted to the chain drive which typically can be roller chain with five inch pitch ANSI #4020 such as Union Chain #US 5031. The roller chain is driven by a power source 1501 and turns on sprocket 1605. The arms are spaced along the chain so that at least one of the arms is in contact with a hinge assembly at all times.

The purpose of the power station is to maintain the interlinked buckets moving through the tunnel and, of course, there may be as many power stations as necessary.

Figure 16:
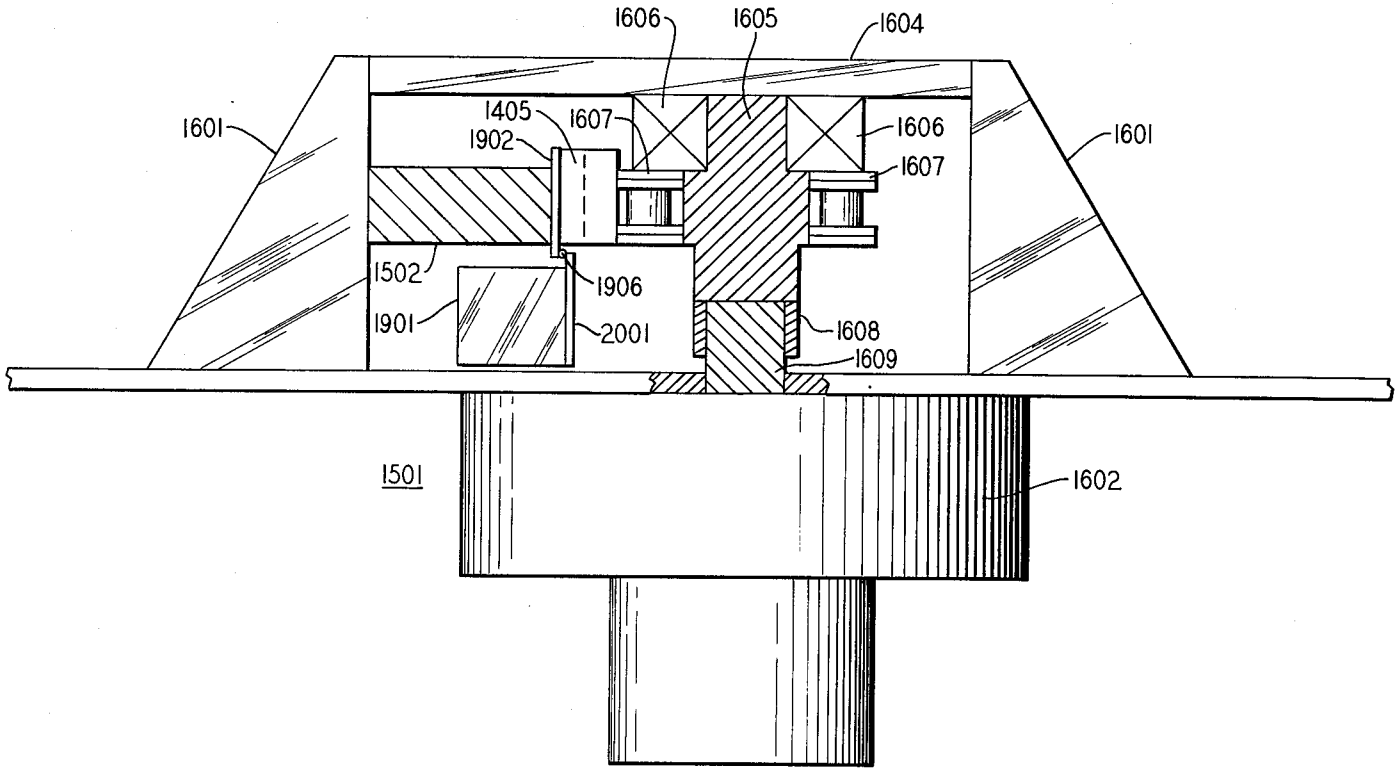

Before the bucket arrives at the power station, the floor terminates so that the bucket, as discussed previously, will open dumping its contents into a hopper or other dumping area. Thus, as the bucket approaches the power station, it has the shape shown in FIG. 21 with plate 1902 sticking up. On one side of plate 1902 the hinge assembly is engaged by arm 1405 or 1404. The other side of plate 1902 is engaged by rubbing block 1502, shown in more detail in FIG. 16. Rubbing block 1603 maintains plate 1902 in contact with arm 1404 or arm 1405. Arm 1404 and 1405 is driven forward by chain 1607 which, in turn, is driven by sprocket 1605 splined by spline 1608 to shaft 1609 of motor 1602. Motor 1602 can be, for example, a hydraulic, such as hydraulic motor KYB270. As shown in FIG. 16, structure 1601 and 1604 serve to brace the entire power station and may be bolted to the mountainside or into the earth, as necessary. Typically, such a structure will be constructed on site to suit the field conditions, but may be, if desired, prefabricated for easy assembly and removal.

Returning again to FIG. 14, a locking pin 1406 may be inserted in a hinge assembly or around a hinge to secure the system during the removal of a bucket. Such a removal is periodically necessary, since the tunnel is continually becoming shorter in length as the coal is mined from the seam. To remove a bucket, the power is turned off at power station 1403 and the power is removed from cylinder 1401. Thus, when an operator removes one or more buckets the tension assembly is moved toward its return position to take up the slack caused by the removed bucket.

It is understood that the embodiments shown are for illustrative purposes only and other arrangements may be used by those skilled in the art without departing from the spirit and scope of my invention.

What I claim is:

1. The method of removing a first solid material from a second solid material when the first material is embedded in the second material in layers, said method comprising the steps of:

surrounding the portion of said first solid material which is to be removed by a driving chain having spaced therealong cutting surfaces, rotating said driving chain and cutting surfaces around said first material in a fixed direction, and applying continuous outward pressure on said driving chain so as to maintain said cutting surfaces in contact with said first material at a location substantially opposite from the location from which said pressure is applied, said pressure being applied with a force sufficient to cause said cutting surfaces to dislodge said contacted first material.

2. The invention set forth in claim 1 wherein said dislodged first material is moved from said contact location toward said pressure applying location by buckets attached to said driving chain.

3. The invention set forth in claim 1 wherein said cutting surfaces at each spaced location along said driving chain are arranged to make contact with said first material across the full layer of said material.

4. The method of removing coal from a horizontal seam comprising the steps of:

forming a continuous tunnel through said coal seam, said tunnel having entrance and exit holes spaced apart across a front surface of said coal seam, expanding said continuous tunnel in height so as to be substantially as high as the seam of coal through which said tunnel is formed, drawing through said formed continuous tunnel a drive chain having spaced therealong cutting surfaces and scooping buckets, rotating said drive chain, cutting surfaces and buckets, through said tunnel in a fixed direction by a drive force located outside of said tunnel, and applying outwardly directed force to said drive chain in a manner to keep said cutting surfaces from contacting the side walls of said tunnel except at those points of said tunnel which are substantially opposite from the location of said drive force.

5. The invention set forth in claim 4 wherein said tunnel is constructed in the shape of a "U" where the two top portions of the "U" correspond to the entrance and exit holes of the tunnel and the bottom portion of the "U" corresponds to a back wall of said tunnel, and wherein said cutting surfaces only contact said tunnel along said back wall.

6. The method of removing coal from a horizontal seam comprising the steps of:

forming a "U" shaped tunnel through said seam, said tunnel having an entrance hole along a face of said coal seam, a first branch running from said entrance hole inside said coal seam; a second branch running laterally to said coal seam face from the distant end of said first branch, and a third branch running from said second branch to an exit hole in said face of said coal seam, expanding said continuous tunnel in height so as to be substantially as high as said seam of coal, placing within said formed tunnel a drive chain having spaced there along cutting surfaces and scooping buckets, rotating said drive chain in a fixed direction through said tunnel by a drive force positioned outside of said tunnel at a location between said entrance and exit holes, applying outwardly directed force to said drive chain in a manner to prevent said cutting surfaces of said rotating drive chain from contacting the side walls of said first and third branches of said tunnel while allowing said cutting surfaces to contact the wall of said second branch of said tunnel nearest said coal seam face so as to allow said rotating cutting surfaces to dislodge coal from said contacted wall, thereby continuously widening said second branch of said tunnel.

7. The method of removing a first material from a second solid material when the first material is embedded in the second material in layers, said method comprising the steps of:

surrounding the portion of said first material which is to be removed by a plurality of directly interlinked buckets, each bucket having at least one side thereof equipped with a cutting edge, rotating said interlinked buckets around said first material in a fixed direction, and applying continuous outward pressure on said interlinked buckets, said outward pressure being applied with a force sufficient to cause said cutting edges of said buckets to contact said first material thereby dislodging said first material.

8. The invention set forth in claim 7 wherein said dislodged first material is scooped into said buckets as said buckets rotate around said first material.

9. The method of removing coal from a horizontal seam comprising the steps of:

forming a continuous tunnel through said coal seam, said tunnel having entrance and exit holes spaced apart across a front surface of said coal seam, expanding said continuous tunnel in height so as to be substantially as high as the seam of coal through which said tunnel is formed, drawing through said formed continuous tunnel a plurality of directly interlinked buckets, each having a cutting surface on the inside thereof, rotating said interlinked buckets through said tunnel in a fixed direction by a drive force located outside of said tunnel, and applying outwardly directed force to said interlinked buckets in a manner to maintain said cutting surfaces of said buckets in contact with the inner wall of said tunnel.

10. The invention in claim 9 wherein each said bucket has a cutting edge displaced in height from the position of the cutting edge on the bucket immediately adjacent thereto.

11. The system for removing coal from a coal tunnel comprising:

means located outside of said tunnel for establishing a rotating force, means for applying an outwardly directed force on said rotating force means, cutting blades for chipping coal from said seam, means for interlinking said cutting blades to form a continuous loop, means included in said loop for removing from said tunnel any coal chipped from said seam, and means for attaching said continuous loop to said rotating force at a position outside of said tunnel so that said loop is rotated through said tunnel, and means controlled by said outwardly directed force to maintain said interlinked cutting blades in contact with said coal seam.

* * * * *